US011267272B2

(12) United States Patent
Toyama et al.

(10) Patent No.: US 11,267,272 B2
(45) Date of Patent: Mar. 8, 2022

(54) PRINTING APPARATUS

(71) Applicant: SEIKO EPSON CORPORATION, Tokyo (JP)

(72) Inventors: Hiroshi Toyama, Shiojiri (JP); Satoru Katagami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/892,680

(22) Filed: Jun. 4, 2020

(65) Prior Publication Data

US 2020/0384781 A1 Dec. 10, 2020

(30) Foreign Application Priority Data

Jun. 7, 2019 (JP) ..... JP2019-106836

(51) Int. Cl.
*B41J 29/377* (2006.01)
*B41J 11/00* (2006.01)

(52) U.S. Cl.
CPC ..... *B41J 29/377* (2013.01); *B41J 11/002* (2013.01); *B41J 11/0024* (2021.01)

(58) Field of Classification Search
CPC ..... B41J 29/377; B41J 11/0024; B41J 11/002
See application file for complete search history.

(56) References Cited

U.S. PATENT DOCUMENTS

2006/0114302 A1* 6/2006 Holtman ..... B41J 2/17593 347/88
2013/0021417 A1* 1/2013 Ota ..... B41J 11/00216 347/85
2016/0089900 A1* 3/2016 Kumai ..... B41J 11/00244 347/102
2018/0229512 A1 8/2018 Katagami
2018/0264849 A1* 9/2018 Kitaoka ..... F26B 3/04

FOREIGN PATENT DOCUMENTS

JP 2018-130901 8/2018

* cited by examiner

*Primary Examiner* — Justin Seo
(74) *Attorney, Agent, or Firm* — Workman Nydegger

(57) ABSTRACT

A printing apparatus includes a support portion configured to support a part of a printing medium to be transported, a heating portion configured to heat the part of the printing medium supported by the support portion, and a curved portion disposed upstream of the support portion in a transport path of the printing medium and including a curved surface that curves the transport path. The curved portion is formed of a member having a lower thermal conductivity than the support portion. In addition, the temperature of the curved portion is lower than the temperature of the support portion.

11 Claims, 7 Drawing Sheets

PRINTING APPARATUS

The present application is based on, and claims priority from JP Application Serial Number 2019-106836, filed Jun. 7, 2019, the disclosure of which is hereby incorporated by reference herein in its entirety.

BACKGROUND

1. Technical Field

The present disclosure relates to a printing apparatus.

2. Related Art

A printing apparatus is disclosed that prints an image by performing intermittent transport in which a long medium wound in a roll shape is repeatedly intermittently transported over an intermittent transport distance and stopped, and ejecting ink from a recording head onto a part of the medium that is stopped on a platen (JP-A-2018-130901).

In JP-A-2018-130901, by heating the platen using a heater concurrently with performing the printing onto the medium, the medium is heated via the platen. In this way, the ink that has landed on the medium is dried.

In the configuration in which the medium is heated on the platen in order to dry the ink, a part of the medium that is heated on the platen shrinks under the influence of heat. On the other hand, an unheated part of the medium, which is positioned upstream of transportation with respect to the platen, does not shrink at all or barely shrinks under the influence of heat. Due to such a difference in an amount of shrinkage caused by the difference in temperature, there have been cases in which wrinkles occur in a part of the medium positioned upstream of the platen.

SUMMARY

A printing apparatus includes a support portion configured to support a part of a printing medium to be transported, a heating portion configured to heat the part of the printing medium supported by the support portion, and a curved portion disposed upstream of the support portion on a transport path of the printing medium and including a curved surface that causes the transport path to curve. The curved portion is formed of a member having a lower thermal conductivity than the support portion.

A printing apparatus includes a support portion configured to support a part of a printing medium to be transported, a heating portion configured to heat the part of the printing medium supported by the support portion, and a curved portion disposed upstream of the support portion on a transport path of the printing medium and including a curved surface that causes the transport path to curve. A temperature of the curved portion is lower than a temperature of the support portion.

DESCRIPTION OF EXEMPLARY EMBODIMENTS

An embodiment of the present disclosure will be described below with reference to each of the accompanying drawings. Each of the drawings is merely illustrative for describing the present embodiment. Since each of the drawings is merely illustrative, shapes and ratios may not be precise or may not match each other, or some portions may be omitted.

1. Schematic Configuration of Printing Apparatus

Figure 1:
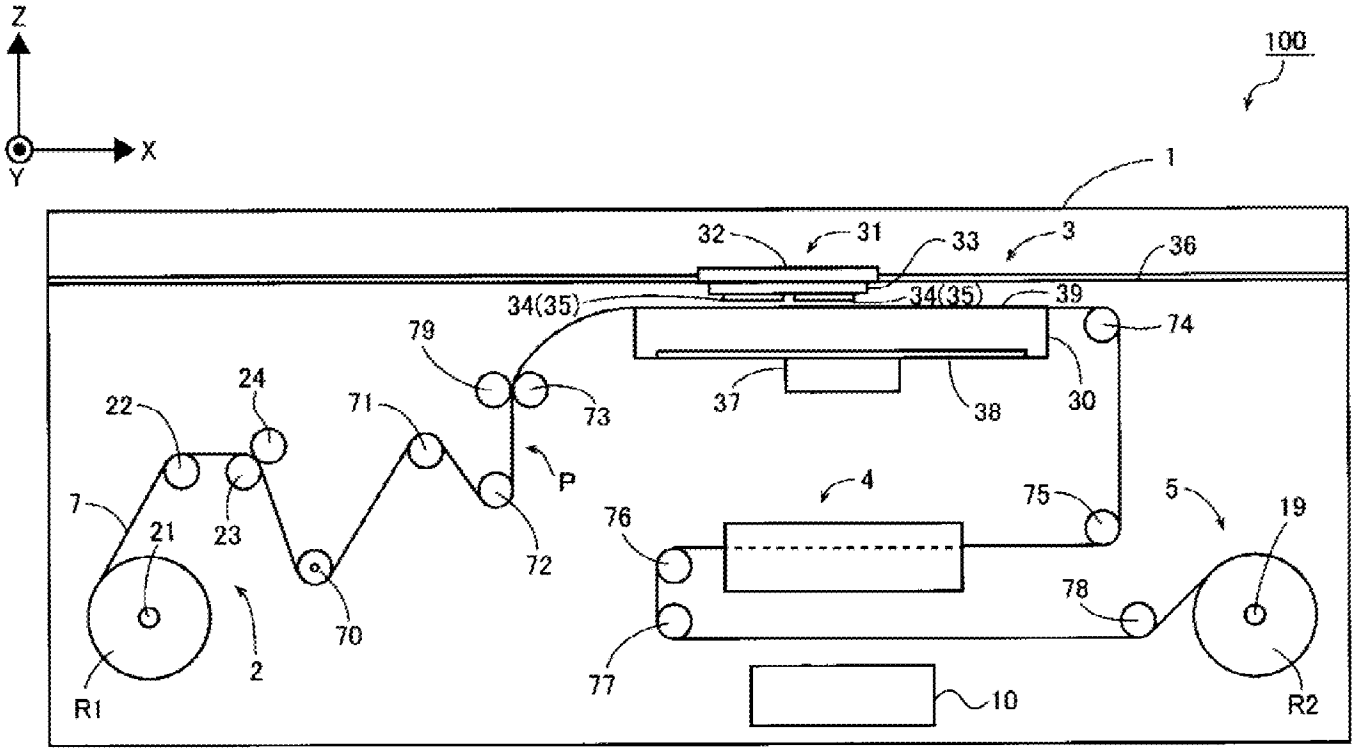
FIG. 1 is a schematic view illustrating a configuration of a printing apparatus.

FIG. 1 is a schematic view illustrating a configuration of a printing apparatus 100. The printing apparatus 100 uses an ink jet method to print an image on a printing medium 7 while feeding the long printing medium 7 wound in a roll shape. The printing apparatus 100 includes a main body casing 1 as a housing. Inside the main body casing 1, a control unit 10 that controls each portion of the printing apparatus 100, a feeding portion 2 that feeds the printing medium 7 unwound from a roll body R1 wound in a roll shape, a printing portion 3 that ejects ink onto the printing medium 7 fed out from the feeding portion 2, a drying portion 4 that dries the printing medium 7 to which the ink has adhered, and a winding portion 5 that takes up the dried printing medium 7 as a roll body R2 are disposed.

In the following description, a longitudinal direction of the main body casing 1 is an X direction, a lateral direction of the main body casing 1 is a Y direction, and an upward direction of the main body casing 1 is a Z direction. In an example of FIG. 1, the direction from left to right is the X direction, and the direction from the rear (rearward) to the front (forward) of the paper in FIG. 1 is the Y direction. The printing portion 3 includes a platen 30 and a printing unit 31. The platen 30 supports a portion of the printing medium 7 from below, on a support face 39 that faces upward. It may be understood that the support face 39 is parallel to the X direction and the Y direction. The platen 30 corresponds to a "support portion". The printing unit 31 performs printing on the printing medium 7 supported by the platen 30.

In the example of FIG. 1, the feeding portion 2, the drying portion 4, and the winding portion 5 are disposed so as to be lower than the printing portion 3. On a transport path P of the printing medium 7, the feeding portion 2 is positioned upstream of the printing portion 3, the drying portion 4, and the winding portion 5, and the winding portion 5 is positioned downstream of the printing portion 3 and the drying portion 4. In the following description, upstream and downstream on the transport path P will be simply described as upstream and downstream. The printing portion 3 is positioned upstream of the drying portion 4.

The feeding portion 2 is provided with a freely rotatable holding shaft 21 that holds the roll body R1 around which the printing medium 7 is wound. Further, the feeding portion 2 includes a roller 22 and a feeding roller 23. The printing medium 7 unwound from the roll body R1 held by the holding shaft 21 is stretched over the roller 22 and the feeding roller 23 in this order. The feeding roller 23 is a driving roller that rotates as a result of a driving force from a motor (not illustrated). The feeding roller 23 feeds out the printing medium 7 by rotating the printing medium 7 pulled out from the holding shaft 21 in a state in which the printing medium 7 is wound on the feeding roller 23. In order to ensure that the printing medium 7 is reliably fed out by the feeding roller 23, the feeding portion 2 is provided with a press roller 24 that is urged toward the feeding roller 23, and the press roller 24 presses the feeding roller 23 with the printing medium 7 interposed therebetween.

The winding portion 5 includes a freely rotatable winding shaft 19. The winding shaft 19 supports the roll body R2 around which the printing medium 7 is wound. The printing medium 7 that is fed out from the feeding portion 2 is transported along the transport path P by being guided by a plurality of rollers 70 to 79, passes through the printing portion 3 and the drying portion 4 in this order, and is directed toward the winding portion 5.

Specifically, the printing medium 7 fed out from the feeding roller 23 is stretched over the movable roller 70 and the rollers 71 and 72 in this order. As a result of its own weight, the movable roller 70 comes into contact, from above, with the printing medium 7 stretched between the feeding roller 23 and the roller 71, and applies tension to the printing medium 7. The transport roller 73 is disposed downstream of the roller 72 and upstream of the platen 30. The transport roller 73 is a driving roller that rotates as a result of a driving force from a motor (not illustrated). The transport roller 73 transports the printing medium 7 onto the platen 30 by rotating the printing medium 7 transported from the rollers 71 and 72 in a state in which the printing medium 7 is wound on the transport roller 73. In order to ensure that the printing medium 7 is reliably transported by the transport roller 73, the transport roller 79 that is urged toward the transport roller 73 is provided, and the press roller 79 presses the transport roller 73 with the printing medium 7 interposed therebetween.

The roller 74 is disposed downstream of the platen 30. The transport roller 73 and the roller 74 are disposed along the X direction with the platen 30 interposed therebetween. The printing medium 7 wound on the transport roller 73 moves in the X direction while being in contact with the support face 39 of the platen 30 until the printing medium 7 reaches the roller 74, and the printing medium 7 wound onto the roller 74 is guided downward. In this way, the printing medium 7 is transported on the support face 39 in the X direction. Therefore, when particular attention is paid to a range of the transport path P including the platen 30, the X direction corresponds to a transport direction of the printing medium 7.

The rollers 75 and 76 are disposed along the X direction so as to be lower than the roller 74. The printing medium 7 wound on the rollers 75 and 76 is guided between the roller 75 and the roller 76 in parallel with the X direction. Further, the drying portion 4 is disposed between the rollers 75 and 76. Thus, the printing medium 7 wound on the roller 75 passes through the drying portion 4 until it reaches the roller 76. The rollers 77 and 78 are disposed downstream of the roller 76, and the printing medium 7 wound on the rollers 77 and 78 is taken up by the winding portion 5.

In this way, the transport path P of the printing medium 7 is substantially formed by each of the above-described rollers and the support face 39 of the platen 30 disposed between the holding shaft 21 and the winding shaft 19. Each of the above-described rollers, the motors for driving each of the rollers, and the like may be referred to as a transport portion for transporting the printing medium 7. Note that the number and the arrangement of the rollers configuring the transport portion is not limited to the mode illustrated in FIG. 1.

The printing unit 31 includes a carriage 32, a flat plate-shaped support plate 33 attached to a lower surface of the carriage 32, and a plurality of printing heads 34 attached to a lower surface of the support plate 33. The printing head 34 includes a plurality of nozzles 35, and prints an image on the printing medium 7 by ejecting, from each of the nozzles 35, ink supplied from an ink cartridge (not illustrated).

The carriage 32 moves integrally with the support plate 33 and the printing heads 34. Specifically, the printing portion 3 is provided with a first guide rail 36 extending in the X direction, and when the carriage 32 receives a driving force from a motor (not illustrated), the carriage 32 moves parallel to the X direction along the first guide rail 36. Further, the printing portion 3 is provided with a second guide rail (not illustrated) extending in the Y direction, and when the carriage 32 receives a driving force from a motor (not illustrated), the carriage 32 moves in the Y direction along the second guide rail.

As a result of the carriage 32 moving in two dimensions with respect to a part of the printing medium 7 that is stopped on the support face 39 of the platen 30, the printing of the image is performed on the printing medium 7. A range of the printing medium 7 supported by the support face 39 is a printing region for one frame by the printing unit 31, and the printing unit 31 performs the printing for one frame on the printing region, based on print data for the one frame. Then, the transport portion transports the printing medium 7 downstream, taking a predetermined distance in the X direction (hereinafter referred to as an intermittent transport distance) as a unit of transport for one cycle. In this way, the printing apparatus 100 performs intermittent transport in which the printing medium 7 is repeatedly intermittently transported over the intermittent transport distance and stopped, and during a transport stop period in which the transport is stopped, the printing unit 31 performs the printing for one frame on the part of the printing medium 7 supported by the support face 39.

In order to keep the printing medium 7 that is stopped on the support face 39 flat, the platen 30 is provided with a mechanism for suctioning the printing medium 7 that is stopped on the support face 39. Specifically, many suction holes (not illustrated) are open in the support face 39, and a suction portion 37 is attached to a lower surface of the platen 30. Then, by operating the suction portion 37 during the transport stop period of the printing medium 7, a negative pressure is generated in the suction holes of the support face 39, and the printing medium 7 adheres to the support face 39. When the printing unit 31 completes the printing for one frame, the suction portion 37 stops the suction of the printing medium 7 and allows subsequent transport of the printing medium 7.

A heater 39 is attached to the lower surface of the platen 30. The platen 30 is heated to approximately 35° C. to 45° C., for example, by the heater 38. The printing medium 7 receives heat from the platen 30 concurrently with receiving ejection of the ink from the printing heads 34. As a result, the ink that has landed on the printing medium 7 is dried, and bleed-through between the ink is suppressed, for example. The heater 38 corresponds to a specific example of a "heating portion" that heats the part of the printing medium 7 supported by the support portion (the platen 30). In the example illustrated in FIG. 1, the heat generated by the heater 38 is transferred to the printing medium 7 via the platen 30. The drying of the printing medium 7 by the heat of the heater 38 is referred to as primary drying. In contrast, the drying of the printing medium 7 by the drying portion 4 is referred to as secondary drying.

The primarily dried printing medium 7 moves as a result of the intermittent transport and is eventually transported to the drying portion 4. A part of the printing medium 7 that is transported to and stopped in the drying portion 4 is heated by a heating unit included in the drying portion 4, and the secondary drying is performed on the part, in order to further dry the ink that has landed on the printing medium 7. The drying portion 4 is also referred to as a drying oven. The heating unit of the drying portion 4 may be a hot air blower or a second heating portion 41, which will be described later based on FIG. 7.

The printing medium 7 is paper, for example. Alternatively, the printing medium 7 may be configured by a printing member on which ink is discharged and printing is carried out, and a support member that is a base paper removably adhered to the printing member. The printing member is, for example, formed by a resin film such as cellophane, stretched polypropylene, polyethylene terephthalate, stretched polystyrene, polyvinyl chloride, and the like. The support member is, for example, formed by high-quality paper, kraft paper, copy paper, glassine paper, parchment paper, rayon paper, coated paper, synthetic paper, and the like.

The control unit 10 includes a processor, such as a CPU, and a memory. In the control unit 10, a processor follows a program stored in a memory in order to control the operation of each of the portions, such as the transport portion, the feeding portion 2, the printing portion 3, the drying portion 4, and the winding portion 5.

For a more detailed description of the printing apparatus 100, JP-A-2018-130901 may be referred to as appropriate.

2. Description of Curved Portion

Although a description has been omitted in FIG. 1, the printing apparatus 100 includes, upstream of the platen 30, a "curved portion 50" having a curved surface that causes the transport path P to curve. Specifically, the curved portion 50 is disposed downstream of the transport roller 73 and upstream of the platen 30.

Figure 2:
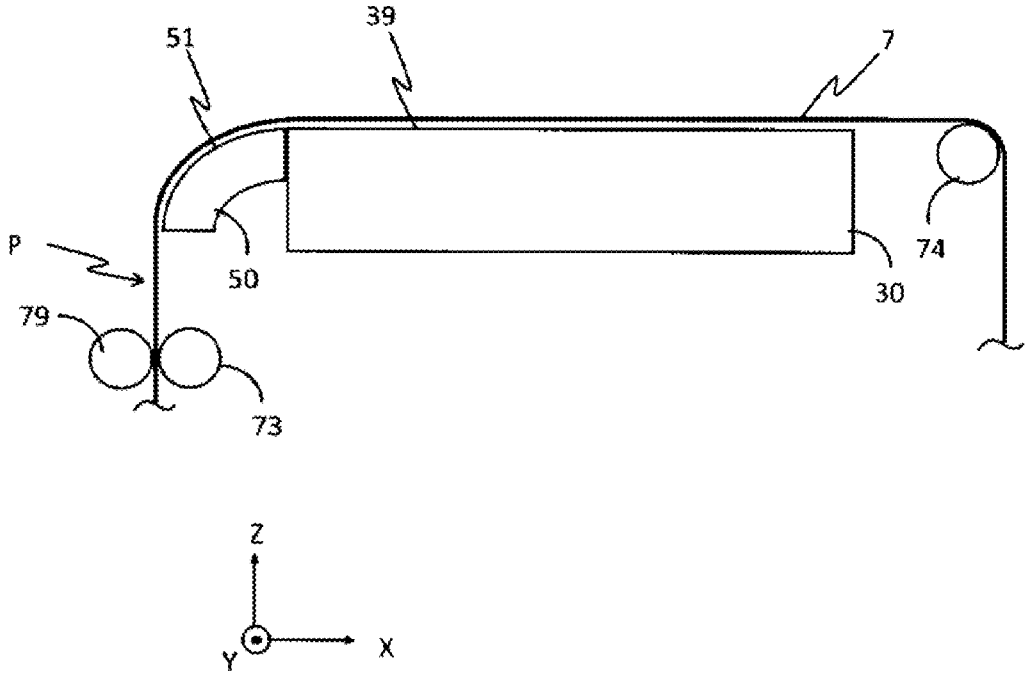
FIG. 2 is a diagram illustrating a configuration including a curved portion of a first example.

FIG. 2 illustrates a range including the platen 30 and the curved portion 50 in the printing apparatus 100 from the same perspective as in FIG. 1. A configuration illustrated in FIG. 2 is also referred to as a first example.

The curved portion 50 has a curved surface 51. The curved surface 51 causes the transport path P, along which the printing medium 7 advances while being transported downstream by the transport roller 73, to curve, and smoothly links the transport path P to the support face 39 of the platen 30. In FIG. 2, for the purpose of better visibility, a gap is provided between the printing medium 7 and the curved surface 51 and the support face 39, but the printing medium 7 is actually transported while being in contact with the curved surface 51 and the support face 39. In the first example, as a result of the curved portion 50 being in contact with an upstream-side end portion of the platen 30, the curved surface 51 and the support face 39 are continuous. Since the curved surface 51 and the support face 39 are continuous, the printing medium 7 can smoothly advance over a boundary between the curved surface 51 and the support face 39.

The curved portion 50 is formed by a member having a lower thermal conductivity than the platen 30. For example, the platen 30 is made of metal, and the curved portion 50 is made of resin. Further, the curved portion 50 is formed of a metal having a lower thermal conductivity than a metal forming the platen 30, for example. As described above, the platen 30 is heated by the heater 38 for the primary drying. On the other hand, since the curved portion 50 is formed by the member having the lower thermal conductivity than the platen 30, the temperature of the curved portion 50 is lower than the temperature of the platen 30. Due to the difference in temperature between the curved portion 50 and the platen 30, a difference in temperature occurs between a part of the printing medium 7 that is in contact with the curved surface 51 and a part of the printing medium 7 that is in contact with the support face 39.

However, of the printing medium 7 transported by the transport roller 73, a part immediately before the part supported by the support face 39, namely, the part in contact with the curved surface 51 curves along the curved surface 51. The curved part of the printed medium 7 has an increased bending rigidity. Bending rigidity indicates how difficult it is to bend or deform an object. Thus, in the part of the printing medium 7 that is in contact with the curved surface 51, an occurrence of wrinkles caused by the difference in temperature is suppressed. In other words, by providing the curved portion 50, wrinkles are less likely to occur in the part of the printing medium 7 positioned upstream of the platen 30.

Figure 3:
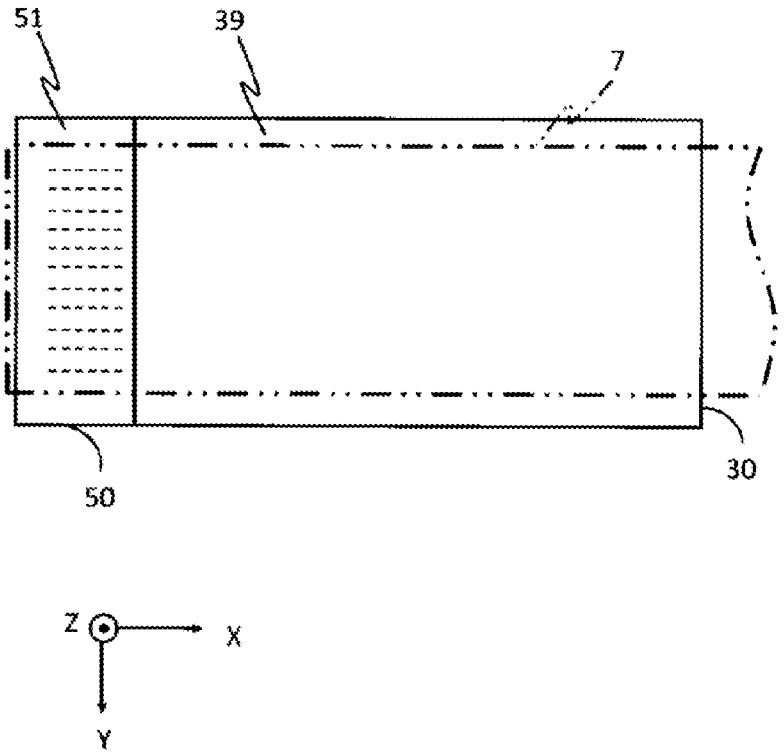
FIG. 3 is a diagram illustrating a size relationship between the curved portion and a printing medium.

FIG. 3 illustrates the configuration illustrated in FIG. 2 as seen from above. However, in FIG. 3, the rollers 73, 74, and 79 illustrated in FIG. 2 are omitted. Further, in FIG. 3, the printing medium 7 is illustrated by a two-dot chain line. As illustrated in FIG. 3, in the Y direction intersecting the X direction, which is the transport direction of the printing medium 7, the width of the curved portion 50 is wider than the width of the printing medium 7. Similarly, in the Y direction, the width of the platen 30 is wider than the width of the printing medium 7. Such a configuration in which the width of the curved portion 50 and the width of the platen 30 are wider than the width of the printing medium 7 is common in each of examples to be described below.

In FIG. 3, in a part of the printing medium 7 positioned upstream of the platen 30, wrinkles of the printing medium 7 are illustrated by a plurality of broken lines. In related art, due to a difference in temperature between different parts of the printing medium 7, a plurality of wrinkles, which are oriented substantially parallel to the X direction and present side by side along the Y direction, are easily generated in a part of the printing medium 7 positioned upstream of the platen 30, but such an occurrence of wrinkles is suppressed as a result of the curved portion 50 being disposed in the present embodiment.

Figure 4:
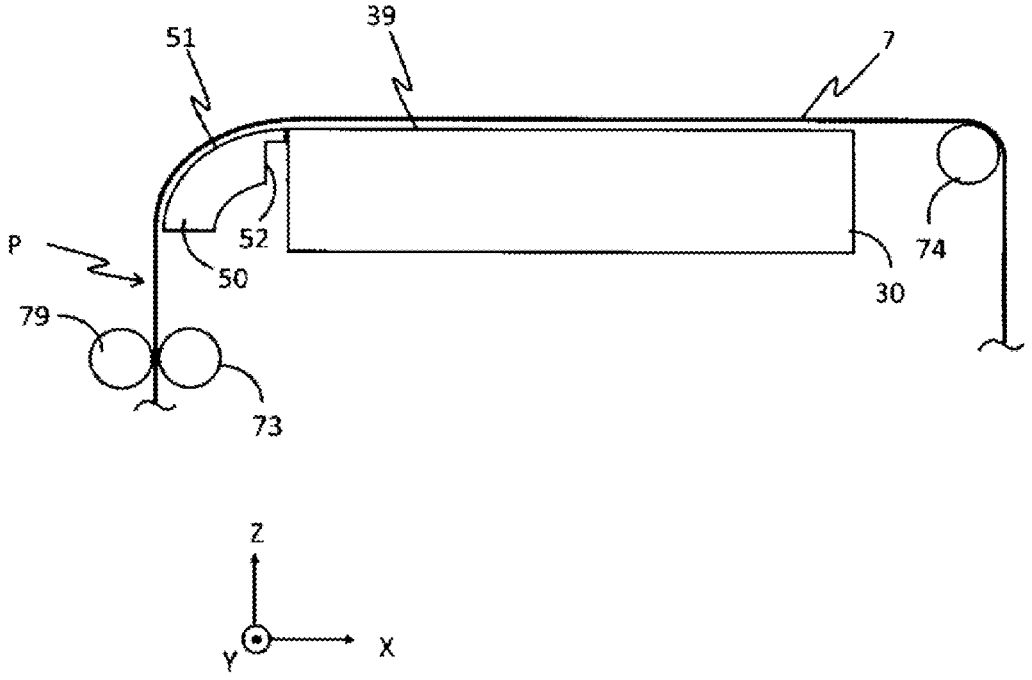
FIG. 4 is a diagram illustrating a configuration including the curved portion of a second example.

FIG. 4 illustrates the range including the platen 30 and the curved portion 50 in the printing apparatus 100 from the same perspective as in FIG. 1. A configuration illustrated in FIG. 4 is also referred to as a second example.

In the second example and each of the examples to be described below, different points from the first example will be mainly described, and content common with the first example will be omitted as appropriate. In the second example, of a downstream-side end portion of the curved portion 50, namely, of an end portion of the curved portion 50 facing the platen 30, a part on which the curved surface 51 and the support face 39 are continuous is in contact with the platen 30. The end portion of the curved portion 50 facing the platen 30 is a recessed portion 52 that is separated from the platen 30, except for the part on which the curved surface 51 and the support face 39 are continuous. In this way, by forming the recessed portion 52 that is separated from the platen 30 in the end portion of the curved portion 50 facing the platen 30, a contact area between the curved portion 50 and the platen 30 is made smaller, and it is thus possible to suppress heat transfer from the platen 30 to the curved portion 50. Note that the end portion of the curved portion 50 facing the platen 30 may be configured so that the curved surface 51 is in contact with the platen 30 at a plurality of locations including the part on which the curved surface 51 and the support face 39 are continuous.

The curved portion 50 need not necessarily be in contact with the platen 30. For example, a gap may be secured between the curved portion 50 and the platen 30 to an extent that does not inhibit the smooth transport of the printing medium 7. If the curved portion 50 is not in contact with the platen 30, the heat is not transferred from the platen 30 to the curved portion 50, and a state can be easily realized in which the temperature of the curved portion 50 is lower than the temperature of the platen 30.

Figure 5:
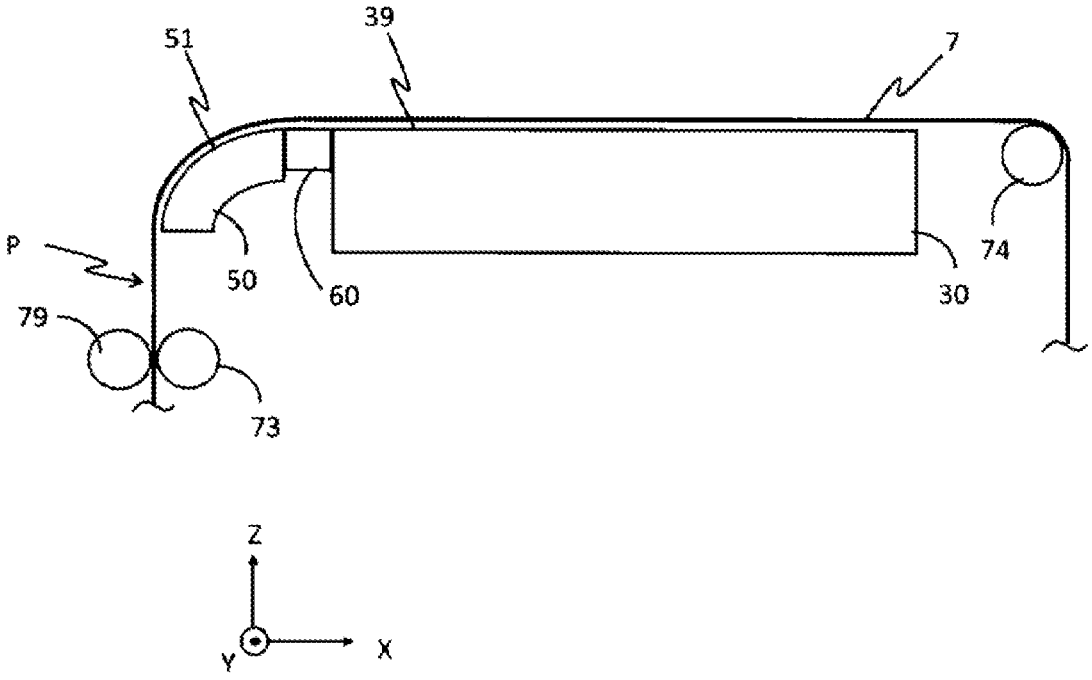
FIG. 5 is a diagram illustrating a configuration including the curved portion of a third example.

FIG. 5 illustrates the range including the platen 30 and the curved portion 50 in the printing apparatus 100 from the same perspective as in FIG. 1. A configuration illustrated in FIG. 5 is also referred to as a third example.

In the third example, the curved portion 50 is not in contact with the platen 30. Specifically, a coupling portion 60 is disposed between the curved portion 50 and the platen 30. The coupling portion 60 is in contact with an upstream-side end portion of the curved portion 50, and is in contact with a downstream-side end portion of the platen 30. The upper surface of the coupling portion 60 is a surface coupling the curved surface 51 of the curved portion 50 and the support face 39 of the platen 30. The coupling portion 60 is formed by a member having a lower thermal conductivity than the platen 30. In this way, by the coupling portion 60 being interposed between the curved portion 50 and the platen 30, the heat transfer from the platen 30 to the curved portion 50 is suppressed, and a state is obtained in which the temperature of the curved portion 50 is lower than the temperature of the platen 30. In the third example, the curved portion 50 may be formed by a member having a lower thermal conductivity than the platen 30 in the same manner as in the first example and the second example, or may be formed by a member having the same thermal conductivity as the platen 30.

Figure 6:
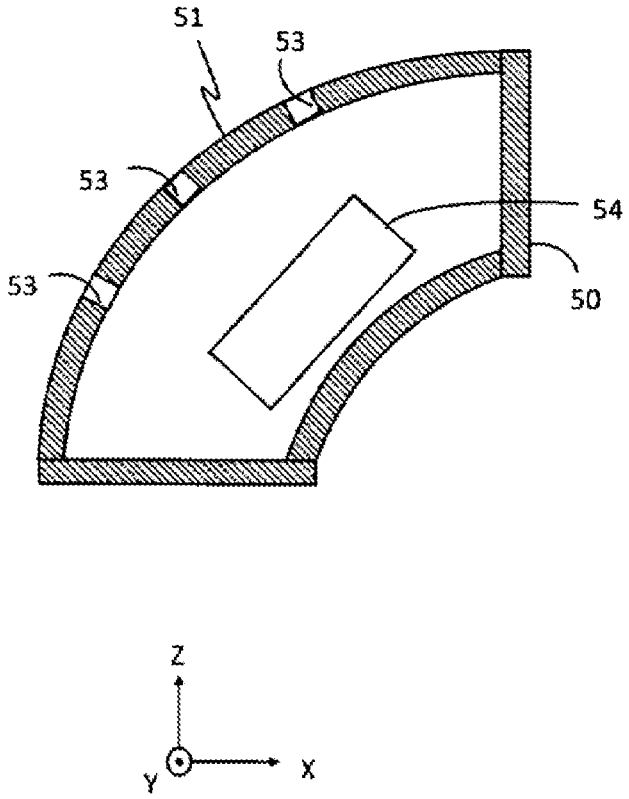
FIG. 6 is a diagram illustrating the curved portion and an airflow adjustment portion of a fourth example.

FIG. 6 illustrates the interior of the curved portion 50 in a simplified manner using a cross-sectional view of the curved portion 50. A configuration illustrated in FIG. 6 is also referred to as a fourth example.

In the fourth example, a plurality of holes 53 penetrating the curved surface 51 are formed in the curved surface 51 of the curved portion 50. Then, the printing apparatus 100 is provided with an airflow adjustment portion 54. In the example of FIG. 6, the curved portion 50 is hollow, and the airflow adjustment portion 54 is housed in the curved portion 50. The airflow adjustment portion 54 includes a motor (not illustrated) and a fan, for example, and can perform exhaust and intake of air by driving the motor and the fan. Such an operation of the airflow adjustment portion 54 is controlled by the control unit 10. As a matter of course, the curved portion 50 may include an air vent besides the holes 53 of the curved surface 51, as appropriate.

Under the control of the control unit 10, the airflow adjustment portion 54 performs the exhaust of the air during a period in which the printing medium 7 is being transported by the transport portion, and sends the air from the inside to the outside of the curved surface 51 via the plurality of holes 53. As a result, frictional resistance of the printing medium 7 received from the curved surface 51 is reduced, and the printing medium 7 is smoothly transported. In addition, such an air exhaust can cool the curved portion 50 and can suppress an increase in the temperature of the curved portion 50 caused by the heat transferred from the platen 30.

On the other hand, during a period in which the printing medium 7 is not being transported by the transport portion, under the control of the control unit 10, the airflow adjustment portion 54 performs the intake of the air, and sucks the air from the outside of the curved surface 51 via the plurality of holes 53. As a result, by bringing the stopped printing medium 7 into close contact with the curved surface 51, the rigidity of the printing medium 7 can be further increased, and the effect of suppressing the wrinkles can be improved.

When the printing medium 7 is transported, the printing medium 7 may be charged with static electricity due to the friction between the printing medium 7 and the curved surface 51. Taking such a situation into account, the airflow adjustment portion 54 may supply air containing ions. The airflow adjustment portion 54 also functions as a so-called ionizer, and discharges the air containing ions generated by the ionizer. As a result, the air containing ions is sent to the outside of the curved surface 51 via the plurality of holes 53, and the charged printing medium 7 can be destaticized.

The configuration described in the fourth example, in which the airflow adjustment portion 54 is provided, can be applied to all the examples described above. In addition, as long as the airflow adjustment portion 54 can fulfill the above-described functions in relation to the curved portion 50, the airflow adjustment portion 54 may be disposed outside the curved portion 50.

3. Summary

As described above, according to the present embodiment, the printing apparatus 100 includes the support portion (the platen 30) that supports a part of the printing medium 7 to be transported, the heating portion (the heater 38) that heats the part of the printing medium 7 supported by the support portion, and the curved portion 50 that is disposed upstream of the support portion on the transport path P of the printing medium 7 and includes the curved surface 51 that causes the transport path P to curve. The curved portion 50 is formed by a member having a lower thermal conductivity than the support portion.

Further, according to the present embodiment, the temperature of the curved portion 50 is lower than the temperature of the support portion (the platen 30).

According to this configuration, the curved surface 51 of the curved portion 50 causes the printing medium 7 to curve and improves the rigidity of the printing medium 7. As a result, an occurrence of wrinkles caused by the above-described difference in temperature is suppressed in the part of the printing medium 7 upstream of the platen 30. When a part of the printing medium 7 in which wrinkles have already occurred is transported onto the platen 30 and the printing is carried out thereon, the image quality as a printing result deteriorates. Further, in order to avoid such a deterioration in the image quality, prior to the printing on the printing medium 7 transported onto the platen 30, an operation such as sucking the printing medium 7 using the suction portion 37 for a long time to eliminate once generated wrinkles is required. As a result, printing efficiency deteriorates. According to the present embodiment, by suppressing the occurrence of wrinkles, various disadvantages associated with such a case in which wrinkles have occurred can be eliminated.

Further, according to the present embodiment, the plurality of holes 53 penetrating the curved surface 51 may be formed in the curved surface 51 of the curved portion 50, and the printing apparatus 100 may include the airflow adjustment portion 54 that sends air from the inside to the outside of the curved surface 51 via the plurality of holes 53 during the period in which the printing medium is being transported.

According to this configuration, the friction between the printing medium 7 and the curved surface 51 can be reduced, and the printing medium 7 can thus be smoothly transported.

Further, according to the present embodiment, the airflow adjustment portion 54 may supply air containing ions.

According to this configuration, the printing medium 7 can be destaticized, and it is thus possible to, for example, prevent ink mist from adhering to the printing medium 7 due to the effect of static electricity.

Further, according to the present embodiment, the airflow adjustment portion 54 may suck air from the outside of the curved surface 51 through the plurality of holes 53 during the period in which the transport of the printing medium 7 is stopped.

According to this configuration, the rigidity of the print medium 7 during the transport stop period can be further increased, and the effect of preventing the wrinkles can thus be improved.

Further, according to the present embodiment, the curved portion 50 and the support portion (the platen 30) may be in contact with each other.

According to this configuration, the gap between the curved portion 50 and the platen 30 can be eliminated, and the printing medium 7 can thus be transported more smoothly.

Further, according to the present embodiment, the curved surface 51 of the curved portion 50 may be continuous with the support face 39 of the support portion (the platen 30) that supports the printing medium 7, and of the end portion of the curved portion 50 facing the support portion, a part that is continuous with the support face 39 may be in contact with the support portion.

According to this configuration, the contact area between the curved portion 50 and the platen 30 can be made smaller, and it is thus possible to suppress the heat transfer from the platen 30 to the curved portion 50.

Further, according to the present embodiment, the printing apparatus 100 may include the coupling portion 60 that is formed by a member having a lower thermal conductivity than the support portion and that is disposed between the curved portion 50 and the support portion (the platen 30).

According to this configuration, the presence of the coupling portion 60 can inhibit the heat transfer from the platen 30 to the curved portion 50, and the temperature of the curved portion 50 can thus be made lower than the temperature of the platen 30.

Further, according to the present embodiment, the width of the curved portion 50 is wider than the width of the printing medium 7 in a direction intersecting the transport direction of the printing medium 7.

According to this configuration, the printing medium 7 can be caused to curve by the curved portion 50 across the entire width of the printing medium 7.

4. Modified Example

A modified example included in the present embodiment will be further described.

As described above with reference to FIG. 1, the drying portion 4 for drying the part of the printing medium 7 that has passed through the support portion is disposed at a position downstream of the support portion (the platen 30) in the transport path P. The printing apparatus 100 may be provided with a second curved portion 80 including a second curved surface 81 that causes the transport path P to curve, at a position downstream of the support portion and upstream of the drying portion 4 in the transport path P. The curved portion 50 described above may be referred to as the first curved portion 50, and the curved surface 51 may be referred to as the first curved surface 51.

Figure 7:
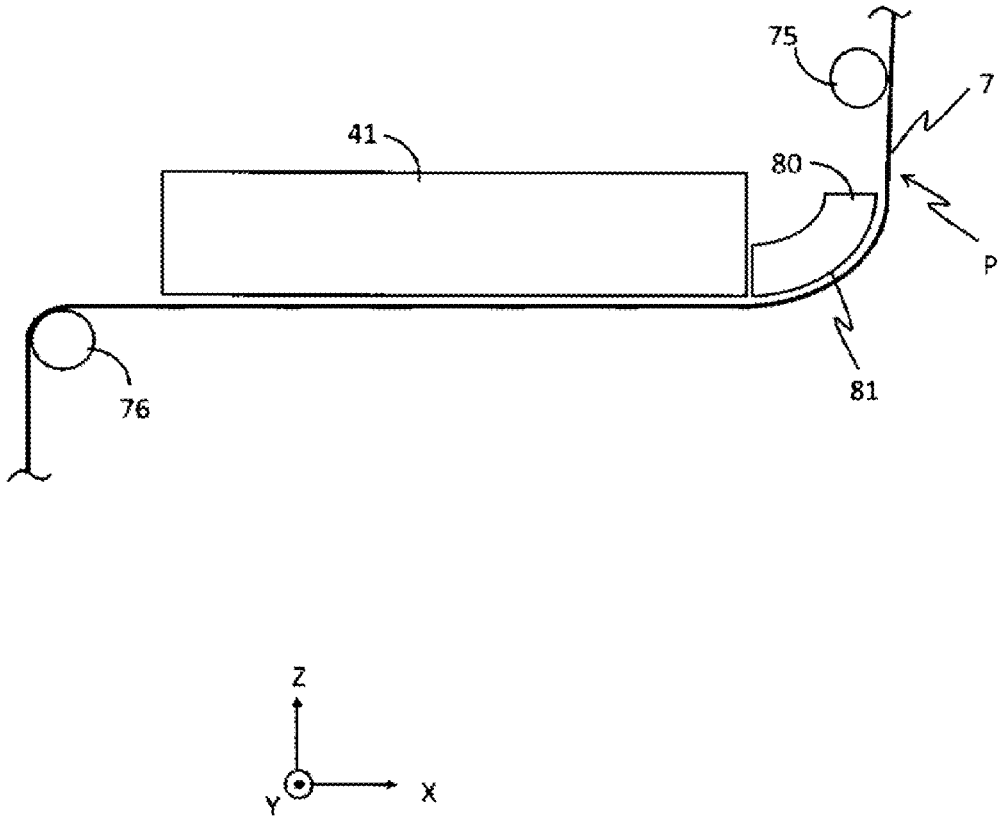
FIG. 7 is a diagram illustrating a configuration including a second curved portion of a modified example.

FIG. 7 is a diagram for describing the modified example and illustrates a range including the second curved portion 80 in the printing apparatus 100 from the same perspective as in FIG. 1. The reference sign 41 is a configuration included in the drying portion 4 and is a second heating portion 41. The second heating portion 41 is heated, for example, by a predetermined heat source, and comes into surface contact with the printing medium 7, which is stopped by the intermittent transport, to perform the secondary drying of the printing medium 7.

According to FIG. 7, the second curved portion 80 is disposed downstream of the roller 75 and upstream of the second heating portion 41. The second curved surface 81 of the second curved portion 80 curves the transport path P along which the printing medium 7 that is guided downstream by the roller 75 advances, and smoothly couples the transport path P to a route for receiving the secondary drying by the second heating portion 41. In the modified example, the printing medium 7 wound on the rollers 75 and 76 is guided between the second curved portion 80 and the roller 76 in parallel with the X direction. In FIG. 7, for the purpose of better visibility, a gap is provided between the printing medium 7 and the second curved surface 81, but the printing medium 7 is actually transported being in contact with the second curved surface 81. The relationship between the first curved portion 50 and the platen 30 is applied to the relationship between the second curved portion 80 and the second heating portion 41. For example, the second curved portion 80 and the second heating portion 41 may be in contact with each other or may be separated from each other. Further, the temperature of the second curved portion 80 is lower than the temperature of the second heating portion 41.

Due to the difference in temperature between the second curved portion 80 and the second heating portion 41, a difference in temperature occurs between a part of the printing medium 7 that is in contact with the second curved surface 81 and a part of the printing medium 7 that is in contact with the second heating portion 41. However, of the printing medium 7 to be transported, the part that is in contact with the second curved surface 81 curves along the second curved surface 81, and the bending rigidity of this part is increased. Thus, in the part of the printing medium 7 that is in contact with the second curved surface 81, an occurrence of wrinkles caused by the difference in temperature is suppressed. In other words, by providing the second curved portion 80, wrinkles are less likely to occur in a part of the printing medium 7, which is upstream of the part of the printing medium 7 that receives the secondary drying by the second heating portion 41. Further, a member similar to the first curved portion 50 or the second curved portion 80, which causes the printing medium 7 to curve in order to prevent the wrinkles, may be provided in the vicinity of the platen 30 at a position downstream of the platen 30, or in the vicinity of the second heating portion 41 at a position downstream of the second heating portion 41.

What is claimed is:

1. A printing apparatus comprising:

a support portion configured to support a part of a printing medium to be transported;

a heating portion configured to heat the part of the printing medium supported by the support portion; and a curved portion disposed upstream of the support portion on a transport path of the printing medium and including a curved surface that causes the transport path to curve, wherein the curved portion is formed of a stationary support member having a lower thermal conductivity than the support portion and that is different from a feed roller that causes the printing medium to be transported.

2. A printing apparatus comprising:

a support portion configured to support a part of a printing medium to be transported;

a heating portion configured to heat the part of the printing medium supported by the support portion; and a curved portion disposed upstream of the support portion on a transport path of the printing medium and including a curved surface that causes the transport path to curve, wherein a temperature of the curved portion is lower than a temperature of the support portion, and the curved portion is a stationary member that supports the medium and that is different from a feed roller that causes the printing medium to be transported.

3. The printing apparatus according to claim 1, wherein a plurality of holes penetrating the curved surface are formed in the curved surface of the curved portion, the printing apparatus comprising an airflow adjustment portion configured to send air from inside to outside of the curved surface via the plurality of holes while the printing medium is being transported.

4. The printing apparatus according to claim 3, wherein the airflow adjustment portion supplies air containing ions.

5. The printing apparatus according to claim 3, wherein the airflow adjustment portion sucks air from the outside of the curved surface through the plurality of holes while transport of the printing medium is being stopped.

6. The printing apparatus according to claim 1, comprising a coupling portion formed of a member having a lower thermal conductivity than the support portion and disposed between the curved portion and the support portion.

7. The printing apparatus according to claim 1, wherein the curved portion and the support portion are in contact with each other.

8. The printing apparatus according to claim 7, wherein the curved surface of the curved portion is continuous with a support face of the support portion supporting the printing medium, and, of an end portion of the curved portion that faces the support portion, a part that is continuous with the support face is in contact with the support portion.

9. The printing apparatus according to claim 1, wherein a width of the curved portion is greater than a width of the printing medium in a direction intersecting a transport direction of the printing medium.

10. The printing apparatus according to claim 1, comprising: a drying portion disposed at a position downstream of the support portion on the transport path and configured to dry a part of the printing medium that passed through the support portion; and a second curved portion disposed at a position downstream of the support portion and upstream of the drying portion on the transport path and configured to cause the transport path to curve.

11. A printing apparatus comprising:

a support portion configured to support a part of a printing medium to be transported;

a heating portion configured to heat the part of the printing medium supported by the support portion; and a curved portion disposed upstream of the support portion on a transport path of the printing medium and including a curved surface that causes the transport path to curve, wherein the curved portion is formed of a member having a lower thermal conductivity than the support portion, and the curved portion and the support portion are in contact with each other.

* * * * *